United States Patent [19]

Hicks

[11] 4,079,483

[45] Mar. 21, 1978

[54] CLEANING OF TEXTILE CARDING MACHINES

[75] Inventor: Harry H. Hicks, Winston-Salem, N.C.

[73] Assignee: Envirotech Corporation, Menlo Park, Calif.

[21] Appl. No.: 747,139

[22] Filed: Dec. 3, 1976

[51] Int. Cl.[2] ..... D01G 15/76

[52] U.S. Cl. ..... 19/107; 55/385 R

[58] Field of Search ..... 19/107; 55/361, 381, 55/385 R

[56] References Cited

U.S. PATENT DOCUMENTS

| | | | |
|---|---|---|---|
| 1,666,379 | 4/1928 | Hartley | 19/107 |
| 3,150,415 | 9/1964 | Reiterer | 19/107 |
| 3,376,610 | 4/1968 | Williams | 19/107 |
| 3,486,309 | 12/1969 | Wild | 19/107 X |
| 3,678,538 | 7/1972 | Sloan | 19/107 |
| 3,877,903 | 4/1975 | Peterson | 55/381 |
| 3,987,517 | 10/1976 | Bonalumi | 19/107 |

FOREIGN PATENT DOCUMENTS

| | | | |
|---|---|---|---|
| 1,019,768 | 2/1966 | United Kingdom | 19/107 |
| 1,148,518 | 4/1969 | United Kingdom | 19/107 |
| 1,138,220 | 12/1968 | United Kingdom | 19/107 |

*Primary Examiner*—Mervin Stein
*Assistant Examiner*—Andrew M. Falik
*Attorney, Agent, or Firm*—William S. Bernheim

[57] ABSTRACT

An air circulating system individual to a card machine is provided for use with a manifold apparatus for pneumatically cleaning about the carding machine.

11 Claims, 7 Drawing Figures

CLEANING OF TEXTILE CARDING MACHINES

BACKGROUND OF THE INVENTION

The present invention relates to pneumatic cleaning of carding machines, and more particularly to a manifold apparatus for the bottom region of a carding machine.

The escape of waste and trash from a carding machine can be classified as exterior and interior. The major exterior escape locations are the so-called lickerin region and the so-called doffer region. The major interior escape location is the space enclosed by the chassis of the carding machine and will be referred to as the bottom region.

Examples of the pneumatic cleaning equipment for use adjacent the lickerin region of the carding machine are illustrated in U.S. Pat. Nos. 3,315,320, 3,707,020 and 3,678,538. Examples of pneumatic cleaning equipment for use adjacent the doffer region of the carding machine are illustrated in U.S. Pat. Nos. 3,604,061, 3,387,337 and 3,357,062.

Typically, the lickerin and doffer plenums capture waste and trash by suction provided through a central ducting system for a number of carding machines with central waste separation. Disadvantages to this mode of operation include a single use of the air, a high pressure central ducting system, and inability to segregate waste from a particular carding machine.

OBJECTS OF THE INVENTION

Accordingly, it is an object of the present invention to provide a new air circulating system for a carding machine which provides air drawn from a lickerin or doffer suction plenum and thereafter cleaned, to the bottom region to transport waste and trash towards a suction orifice positioned therein.

Another object of the invention is to provide each carding machine having a bottom manifold apparatus with an air circulating system individual to that machine to allow a low pressure, clean air, central air system to be used for the carding room.

BRIEF DESCRIPTION OF THE FIGURES

Further objects and advantages of the invention will be apparent from the following detailed description, taken in conjunction with the accompanying drawings illustrating preferred embodiments of the invention.

In the drawings, which are schematic in order to illustrate the essence of the invention.

DETAILED DESCRIPTION OF A PREFERRED EMBODIMENT

Figure 1:
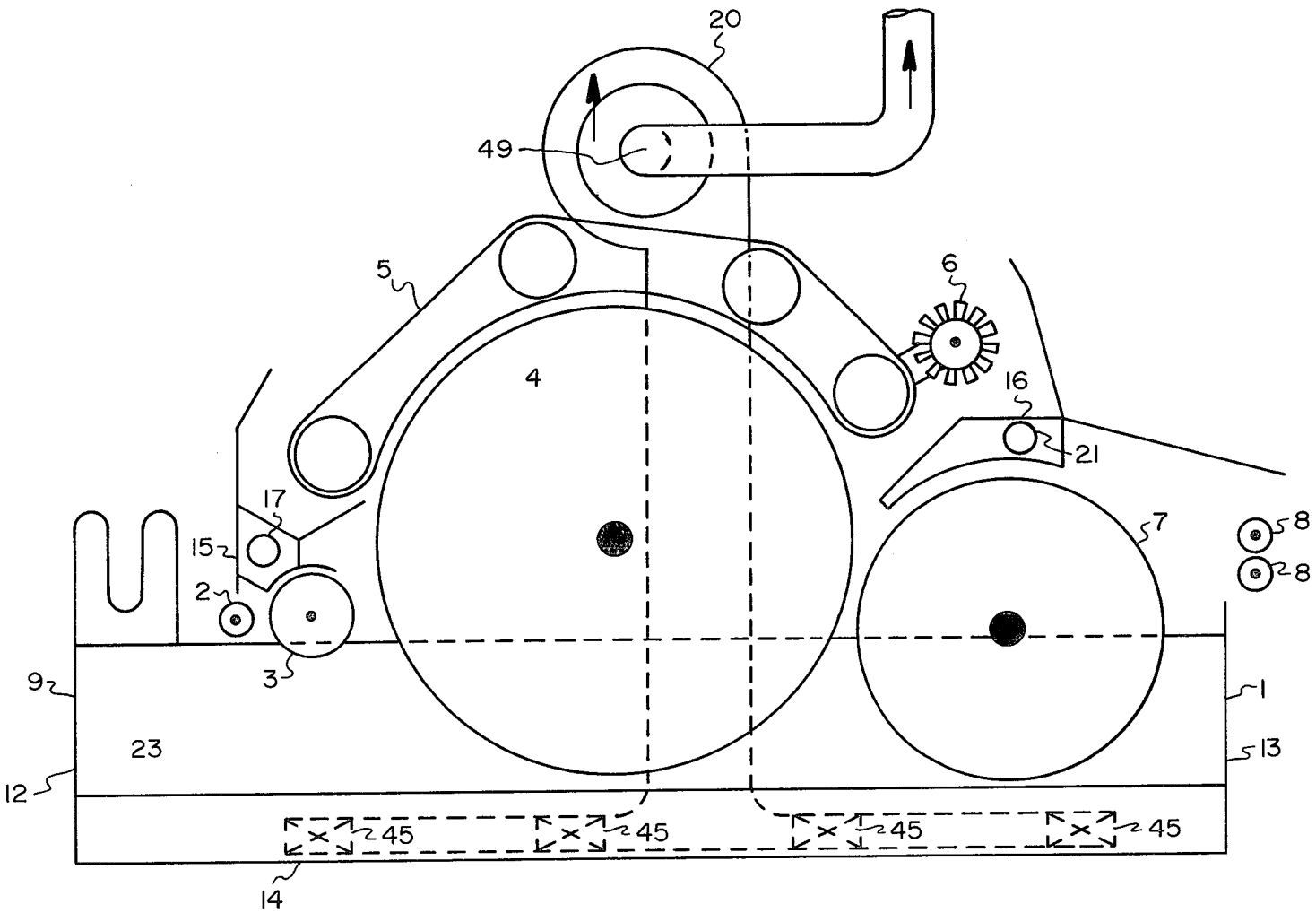
FIG. 1 is a side elevation view of a carding machine with a pneumatic cleaning system according to the present invention.

In FIG. 1, a carding machine 1 of the usual type includes a feed roll 2 arranged to deliver a lap of fibrous material to a main lickerin 3 which, in turn, carries the material to a main card cylinder or swift 4. Mounted above the swift and adjacent to its surface is a chain 5 of carding flats which are arranged to align the fibers in the material carried by the swift. A brush 6 is mounted to contact and brush the flat chain 5. A doffer 7 removes the fibrous material as a web from the swift and delivers it to a pair of calender rolls 8 at the front of the carding machine 1. Inasmuch as the structure and operation of the above mentioned components of the carding machine are well known, they are not described in further detail.

Figure 2:
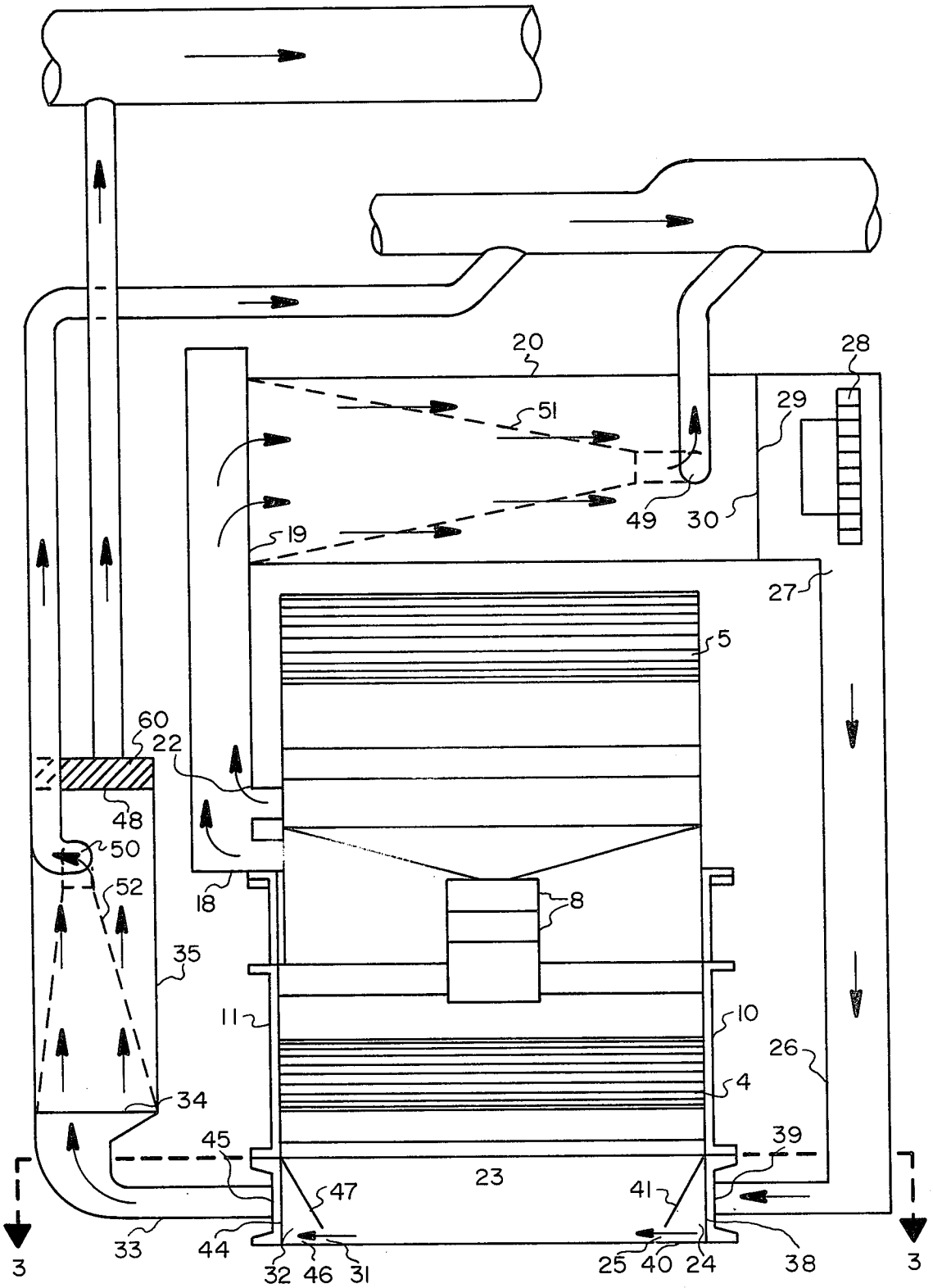
FIG. 2 is an end view of the carding machine of FIG. 1.

Mounted on the carding machine to pneumatically clear waste and trash from the lickerin region and from the doffer region are suction plenums 15 and 16, respectively, each having a slot orifice extending from side to side across the carding machine. Suction is applied to the lickerin plenum 15 by connecting to an aperture 17 in the plenum a suction duct 18 in communication with an inlet 19 of a waste concentrator 20 as shown in FIG. 2. Suction is applied to the doffer plenum 16 by connecting to an aperture 21 in the plenum a suction duct 22 in communication with the inlet 19. The structure and operation of the doffer and lickerin plenum means are also well known and, for that reason, need not be described in further detail.

The carding machine 1 is supported by a chassis housing 9 resting on the floor 14 of the carding room in which the machine is used. Mounted to the chassis housing 9 below the carding machine proper to define an enclosure 23 are side walls 10 and 11, and end walls 12 and 13.

Figure 3:
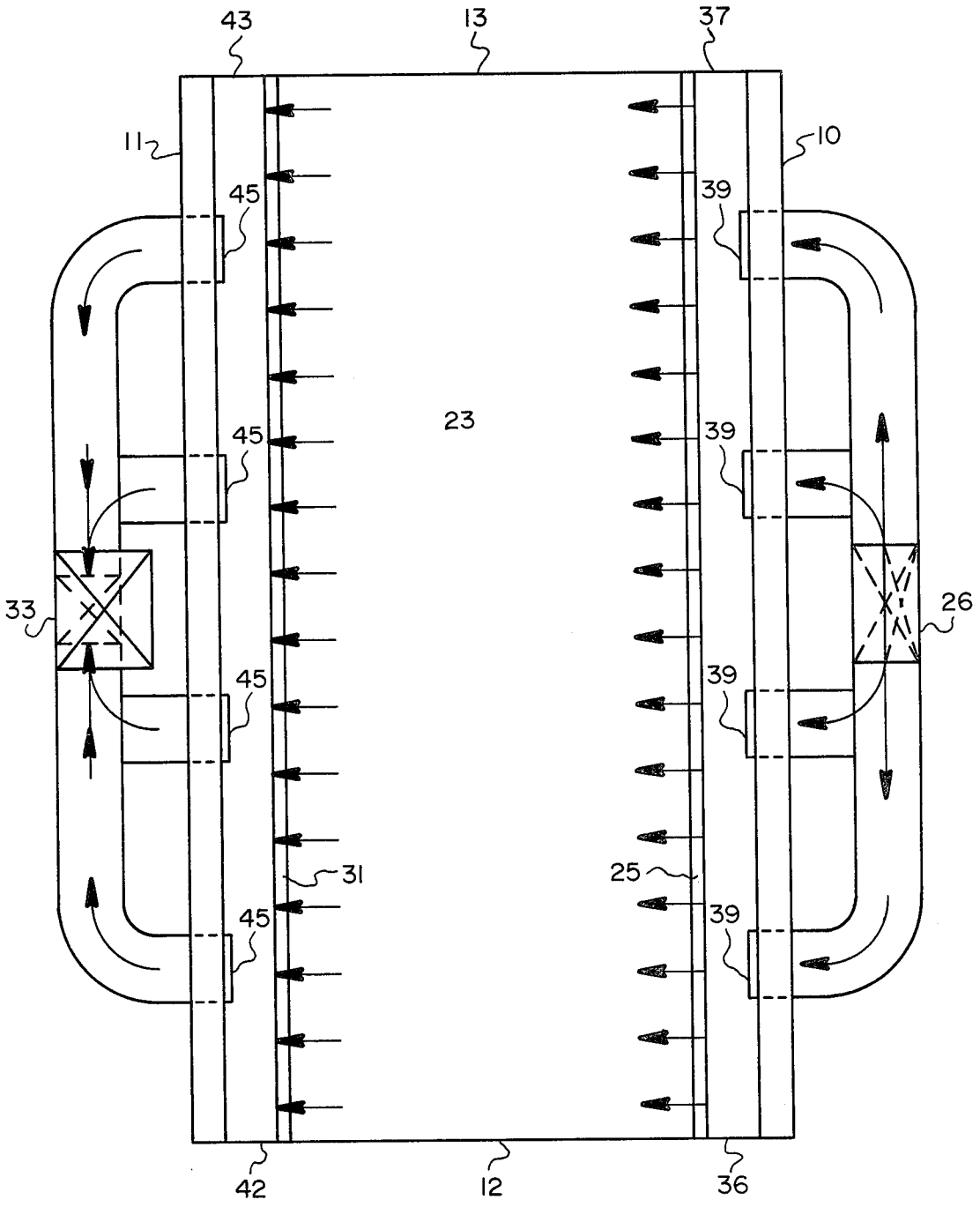
FIG. 3 is a horizontal section view taken along line 3—3 of FIG. 2.

The enclosure 23 defines a bottom region beneath the carding components where particles of waste and trash from the carding components fall and collect. Referring now to FIGS. 2 and 3 generally, to pneumatically clean waste and trash from the enclosure 23 a pressure plenum 24 is formed to have an orifice 25 extending along one side 10 of the housing 9. Air is provided to the pressure plenum 24 through a duct 26 from an outlet 27 of a fan 28. The fan 28 has an inlet 29 for admitting the discharge from an air outlet 30 of the waste concentrator 20. The pressurized air is emitted through orifice 25 into the bottom region 23 from the pressure plenum 24 to transport waste and trash toward a suction orifice 31 located opposite to receive the emitted air. A suction plenum 32 is formed to have the orifice 31 extend along the opposite side 11 of the housing 9. Air is drawn by negative pressure from the suction plenum 32 through a duct 33 to an inlet 34 of a second waste concentrator 35. The drawing of air from the plenum 32 in turn draws air, waste and trash from the bottom region 23 through orifice 31. The two plenums 24 and 32 can be of identical configuration and by reversing the ducting interchange in function.

The pressure plenum 24 is preferably a triangular cross-sectional plenum chamber located within the bottom region 23 along and extending the length of the side wall 10 of the carding machine at the floor 14. The orifice 25 is a horizontally opened slot close to the side wall 10 and extending from end wall 12 to end wall 13.

More particularly, the pressure plenum 24 includes a pair of generally triangular side plates 36 and 37 of similar profile and construction for use as right and left plenum sides. A vertical panel 38 of generally planar rectangular configuration is attached at its sides to the side plates. The vertical panel 38 has an aperture therethrough, preferably a plurality of apertures 39 to which the duct 26 is attached. A horizontal panel 40 of generally planar rectangular configuration is attached to bottom edges of the side plates. An inclined panel 41 of generally planar rectangular configuration is attached to the side plates to contact along one panel edge with the vertical panel 38 and to define the orifice 25 between its opposite panel edge and the horizontal panel 40. The angle of the inclined panel 41 should be sufficient to cause waste alighting thereon to slip and fall to the floor 14.

Figure 4:
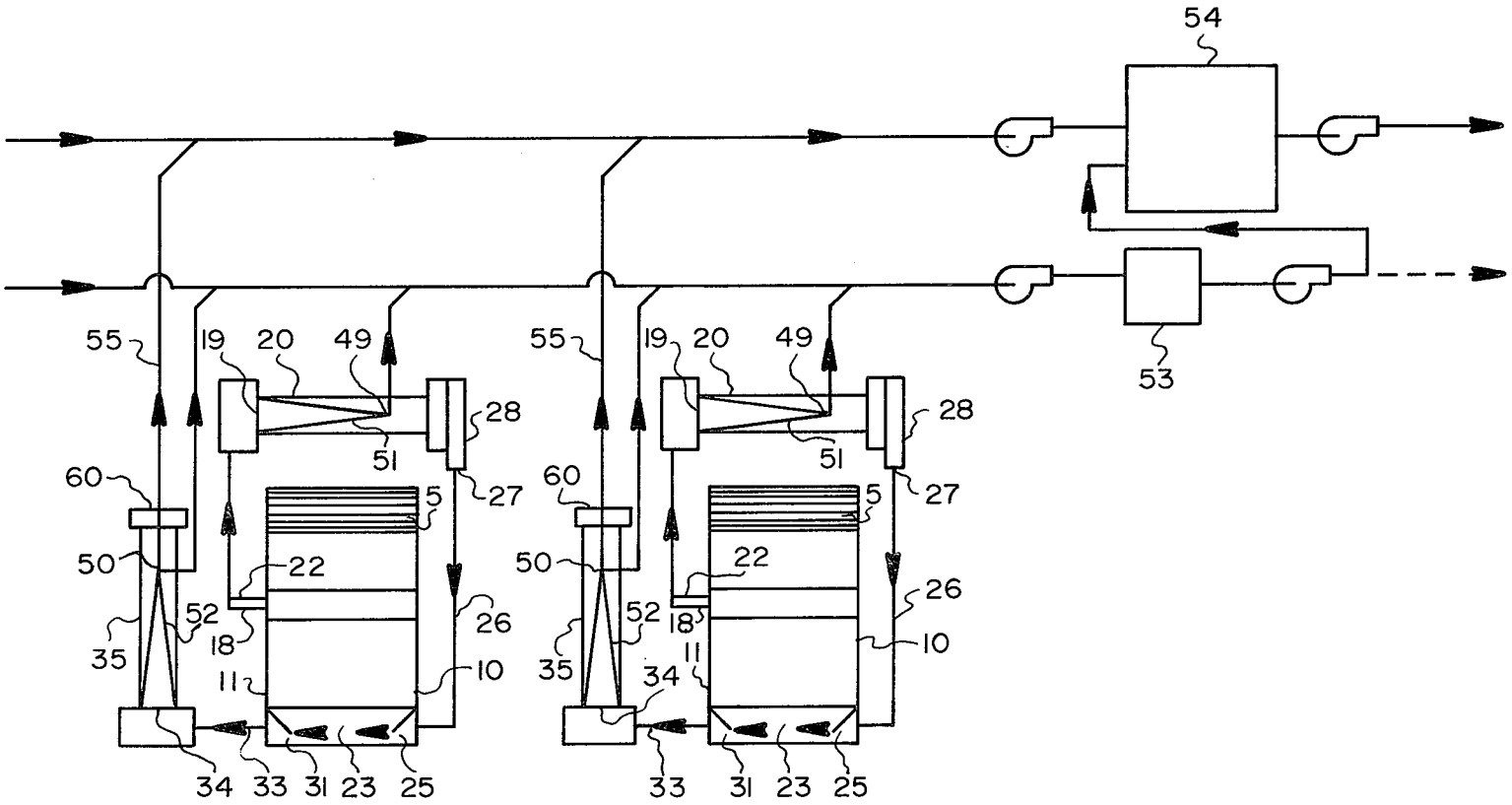
FIG. 4 is a schematic diagram of a circulating system for an individual carding machine and overall system for a plurality of carding machines according to the present invention.

As shown in FIGS. 1, 2 and 4, the carding machine is preferably elevated a substantial distance above the carding room floor by mounting the carding machine on a walled rectangular frame of about 2 to 14 inches in height. The additional height provides a large unobstructed space beneath the carding machine 1 as part of the bottom region 23 in which to position the pressure plenum 24 and the suction plenum 32. The added clearance between the carding components and the floor 14 lessens any turbulence about the carding components as air is blown from orifice 25 to orifice 31.

The suction plenum 32 is preferably a triangular cross-sectional plenum chamber located within the bottom region along and extending the length of the other side wall 11 of the carding machine at the floor 14. The orifice 31 is a horizontally opened slot close to side wall 11 opposite and spaced from orifice 25 and extending from end wall 12 to end wall 13.

Figure 7:
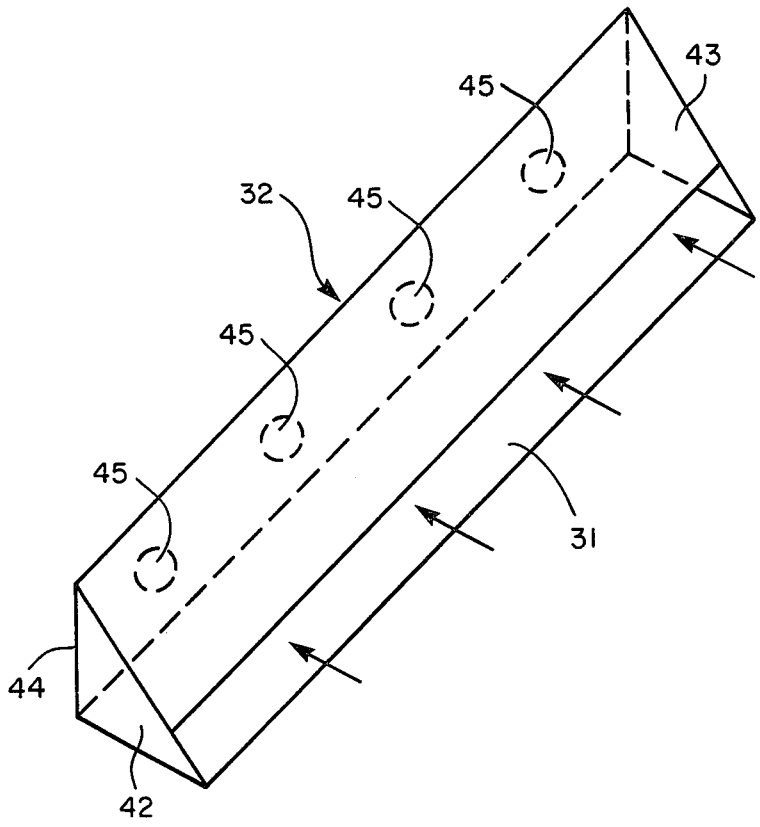
FIG. 7 is a perspective view of the suction plenum 32 shown in FIG. 3.

More particularly, the suction plenum 32, as shown in FIG. 7, includes a pair of generally triangular side plates 42 and 43 of similar profile and construction for use as right and left plenum sides. A vertical panel 44 of generally planar rectangular configuration is attached to the side plates. The vertical panel 44 has an aperture therethrough, preferably a plurality of apertures 45 to which the duct 33 is attached. A horizontal panel 46 of generally planar rectangular configuration is attached to bottom edges of the side panels 42 and 43. An inclined panel 47 of generally planar rectangular configuration is attached to the side plates to contact along one panel edge with the vertical panel 44 and to define the orifice 31 between its opposite panel edge and the horizontal panel 46. The angle of the inclined panel 47 should be sufficient to cause waste alighting thereon to slip and fall to the floor 14.

As shown in the Figures, the plenums 24 and 32 can be integrated with the carding machine chassis 9 with, respectively, the side walls 10 and 11 serving as the vertical panels 38 and 44, the floor 14 serving as the horizontal panels 40 and 46 and the end walls 12 and 13 serving as the side plates 36, 37, 42 and 43 with the triangular shape being defined by the attachment of the inclined panels 41 and 47.

Although the pressure plenum 24 and suction plenum 32 are illustrated and described in the foregoing as each comprising a single unit, alternatively they could each comprise a plurality of plenums. Multiple plenums can be used where there are clearance or obstruction problems and to control the air flow distribution. For the same reason a plurality of orifices 25 and 31 can be utilized to advantage.

The waste concentrators 20 and 25 are preferrably conical condensers including a cylindrical housing having the inlets 19 and 34, respectively, at one end, air outlets 30 and 48, respectively, at the opposite end and waste outlets 49 and 50, respectively. The air inlets 19 and 34 are attached to ducts 26 and 33, respectively to receive a flow of air entraining waste and trash. The air outlets 30 and 48 discharge a large portion, approximately 90% of the flow of air, cleared of entrained waste and trash. Waste outlets 49 and 50 respectively are positioned intermediate the inlet and air outlet and have a substantially reduced cross-sectional area as compared to their respective inlets. The waste outlets discharge a small portion of the flow of air approximately 10%, with the waste and trash concentrated therein.

The inlets 19 and 34 and their waste outlets 49 and 50 are interconnected by gradually tapering foraminous frusto-conical walls 51 and 52, respectively, of woven nylon mesh or like material, which clear the air passing therethrough to the air outlets 30 and 48 of waste and trash but not dust. The concentrators 20 and 35 handle the initial large volumes of air required for continuous waste and trash removal from the plenums and transport across floor 14 and effects the desired waste and trash concentrations to within the capacity of a conventional waste-separating apparatus 53 which is connected to the waste outlets 49 and 50.

The waste-separating apparatus 53 separates waste and trash from the air streams. The air discharged from the waste-separating apparatus 53 can be discharged to a conventional central air filter 54 for dust removal or to the atmosphere.

As mentioned previously, the suction plenum 32 can include a plurality of plenums. Each of these plenums can be connected to separate waste concentrators 35 to allow segregation of the waste and trash from different areas of the bottom region 23.

The air outlet 48 connects by duct 55 to the central air filter 54. Preferably, a fan 60 is attached at air outlet 48 to provide the negative pressure for operation of the suction plenum 32 and the waste concentrator 35. Since the waste is separated from the air at waste air outlet 48 the central air filter 54 transports clean air and, therefore, can handle air from all cards regardless of the fiber being processed.

In a typical operation, cotton fiber for processing is fed to the carding machine and is passed in turn from the feed roll 2 to the lickerin 3, to the main cylinder 4, to the doffer 7 and to the calender rolls 8. During the fiber's passage through the machine, waste and trash escape to the atmosphere in the lickerin region and the doffer region and fall to the floor 14 in the bottom region from the carding components.

As an example, to capture this waste and trash approximately 833 cfm is drawn through inlet 19 of the waste concentrator 20 from the lickerin plenum 15 and doffer plenum 16. The drawing of air captures waste and trash about the orifices of the plenums and transports the waste and trash to the waste concentrator 20.

In the waste concentrator 20, 750 cfm is cleared of waste and trash by passage through the foraminous wall 51. The 750 cfm is emitted through the air outlet 30 and passes to fan 28 which provides the majority of the power needed to circulate the air. The remaining 83 cfm carrying the now concentrated waste and trash is emitted through waste outlet 49 and passes to the waste-separating apparatus 53.

From the fan 28 the 750 cfm is fed through duct 26 to the pressure plenum 24. In the pressure plenum 24, the 750 cfm is emitted through orifice 25 horizontally across the bottom region 23 and transports waste and trash falling to floor 14 toward orifice 31 for capture. Approximately 900 cfm is drawn from bottom suction plenum 32 and delivered to inlet 34 of the waste concentrator 35.

The 350 cfm difference between the 750 cfm emitted by orifice 25 and the 900 cfm suctioned by orifice 31 is drawn into the bottom region 23 through holes provided in the chassis to admit room air.

The air outlet 48 of the waste concentrator 35 delivers 810 cfm to the central air filter for dust removal. The waste outlet 50 delivers 90 cfm to the waste-separating apparatus 53.

A side-to-side air flow velocity of about 80–160 ft/min., and preferably about 120 ft/min. from orifice 25 to orifice 31 is satisfactory to transport waste and trash across floor 14 without interfering with the carding process. If large amounts of dirt are present in the bottom region 23, flow velocities up to 250 ft/min. can be necessary.

Figure 5:
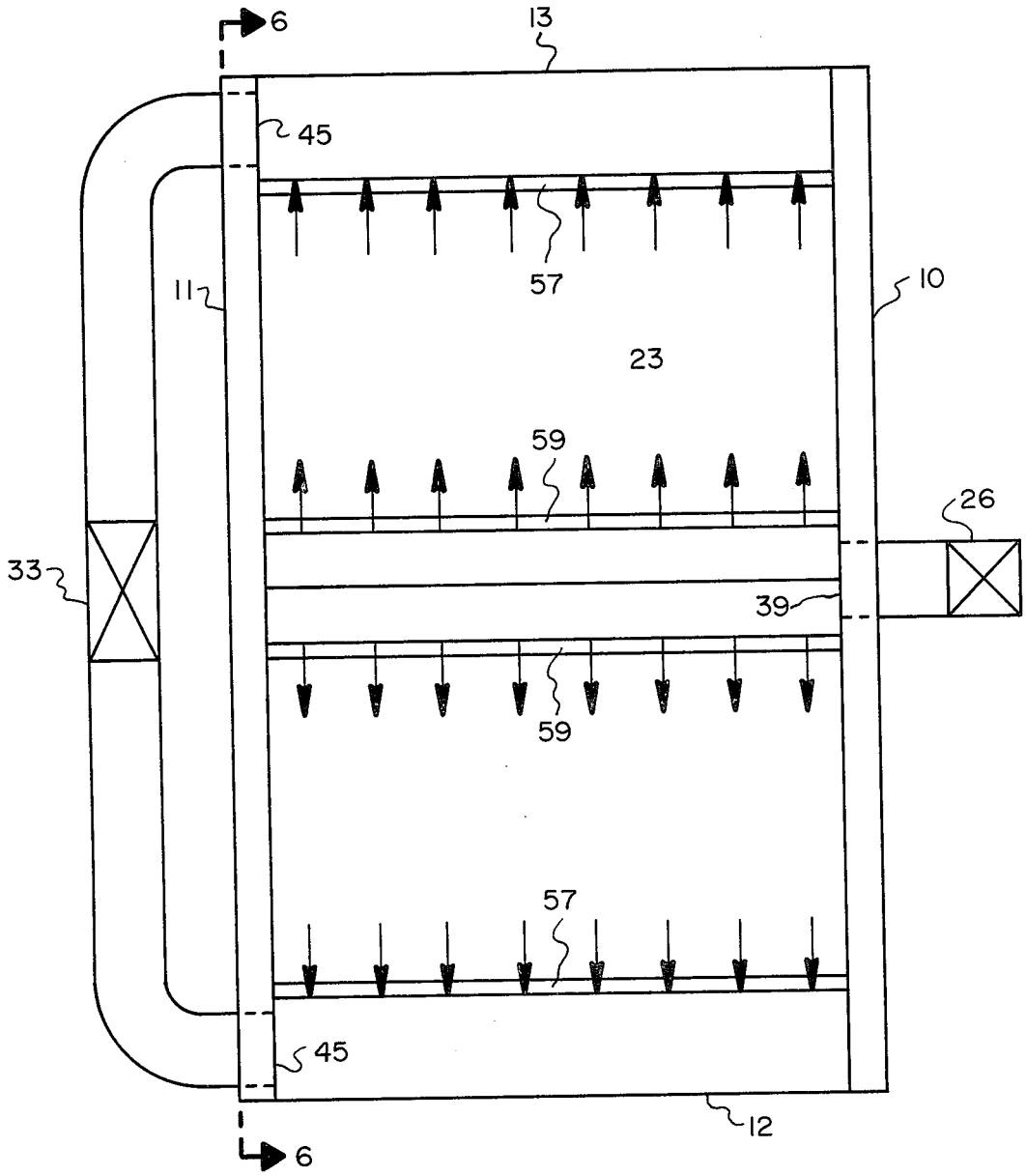
FIG. 5 is a horizontal section view of the bottom region 23 showing an alternative bottom plenum configuration according to the present invention.
Figure 6:
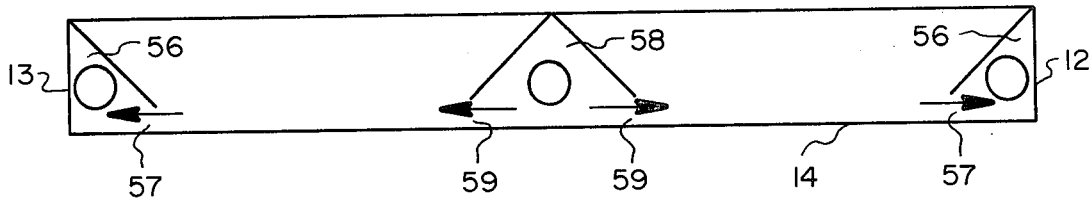
FIG. 6 is a side view of the horizontal section view of FIG. 5 taken along line 6—6.

An alternative bottom plenum configuration is shown in FIGS. 5 and 6 which has no plenums along side walls 10 and 11. Instead, in the bottom region 23 triangular suction plenums 56, constructed in the same manner as suction plenum 32, are positioned along each of the end walls 12 and 13 with orifices 57 extending from side wall to side wall to suction air from the bottom region. Spaced from both ends and preferably beneath the main cylinder is a pressure plenum 58 having two orifices 59 extending from side wall to side wall one opposite each of the suction orifices 57. The orifices 59 of the pressure plenum 58 emit air toward and to be received by their respective orifices 57 of the suction plenums.

I claim:

1. An apparatus for removing waste and trash from a carding machine including a supporting chassis set upon a carding room floor, the chassis having side walls which are parallel to the flow of fiber through the machine and end walls to define an enclosed bottom region in the machine beneath carding components, comprising:

a. a first suction plenum mounted to said machine and having an orifice extending in the side to side direction to capture waste and trash in a major exterior escape region of said machine;

b. a first waste concentrator means connected to said first suction plenum to receive a flow of air from said first suction plenum and separate the flow into a large volumetric flow of air cleared of entrained waste and trash and a small volumetric flow of air in which waste and trash is concentrated;

c. a first means attached to said machine to provide a flow of cleared air from said first waste concentrator means under positive pressure into the bottom region;

d. a pressure plenum mounted to the machine, said pressure plenum connected in communication with said first means to receive the flow of air under pressure and having an emitting orifice to emit pressurized air into the bottom region;

e. a second means attached to said machine to draw under a negative pressure a flow of air entraining waste and trash from the bottom region;

f. a second suction plenum connected to said second means, mounted to the machine and having a receiving orifice formed spaced from and opposite the emitting orifice through which is drawn a flow from the emitting orifice after the flow has crossed the floor and entrained waste and trash; and g. a second waste concentrator means connected to said second plenum to receive a flow from said second suction plenum and separate this flow between a large volumetric flow of air clear of entrained waste and trash and a small volumetric flow of air in which the waste and trash is concentrated.

2. The apparatus of claim 1 wherein said major exterior escape region is the lickerin region.

3. The apparatus of claim 1 wherein said major exterior region is said doffer region.

4. The apparatus of claim 1 wherein said first suction plenum includes a plenum in said lickerin region and a plenum in said doffer region.

5. The apparatus of claim 1 wherein said pressure plenum is mounted on a first sidewall of said chassis and defines an orifice extending in the end-to-end direction and said second suction plenum is mounted along the opposite sidewall of the chassis and defines an orifice extending in the end-to-end direction.

6. The apparatus of claim 1 further including a separate means connected to the base of the chassis to elevate the machine a substantial distance above the carding room floor.

7. The apparatus of claim 6 wherein said separate means includes a walled rectangular frame which is 2 to 14 inches in height.

8. An apparatus for removing waste and trash from a carding machine including a supporting chassis set upon a carding room floor, the chassis having side walls which are parallel to the flow of fiber through the machine and end walls to define an enclosed bottom region in the machine beneath carding components, comprising:

a. a first suction plenum mounted to said machine and having an orifice extending in the side to side direction to capture waste and trash in a major exterior escape region of said machine;

b. a first waste concentrator means connected to said first suction plenum to receive a flow of air from said first suction plenum and separate the flow into a large volumetric flow of air cleared of entrained waste and trash and a small volumetric flow of air in which waste and trash is concentrated; said first waste concentrator means includes a conical condenser comprising a cylindrical housing having an inlet at one end for receiving the flow from said first suction plenum, a first outlet at its opposite end for discharging the large volumetric flow and a second outlet to discharge the small volumetric flow, positioned intermediate the inlet and first outlet, and substantially reduced in cross-sectional area as compared to the inlet, the inlet and second outlet being interconnected by a gradually tapering foraminous frusto-conical wall;

c. a first means attached to said machine to provide a flow of cleared air from said first waste concentrator means under positive pressure into the bottom region;

d. a pressure plenum mounted to the machine, said pressure plenum connected in communication with said first means to receive the flow of air under pressure and having an emitting orifice to emit pressurized air into the bottom region;

e. a second means attached to said machine to draw under a negative pressure a flow of air entraining waste and trash from the bottom region;

f. a second suction plenum connected to said second means, mounted to the machine and having a receiving orifice formed spaced from and opposite the emitting orifice through which is drawn a flow from the emitting orifice after the flow has crossed the floor and entrained waste and trash; and g. a second waste concentrator means connected to said second plenum to receive a flow from said second suction plenum and separate this flow between a large volumetric flow of air clear of entrained waste and trash and a small volumetric flow of air in which the waste and trash is concentrated.

9. The apparatus of claim 8 wherein said second waste concentrator means includes a conical condenser comprising a cylindrical housing having an inlet at one end for receiving the flow from said second suction plenum, a first outlet at its opposite end for discharging the large portion and a second outlet positioned intermediate the inlet and first outlet, and substantially reduced in cross sectional area as compared to the inlet; the inlet and the second outlet being interconnected by a gradually tapering foraminous frusto-conical wall.

10. An apparatus for removing waste and trash from a carding machine including a supporting chassis set upon a carding room floor, the chassis having side walls which are parallel to the flow of fiber through the machine and end walls to define an enclosed bottom region in the machine beneath carding components, comprising:

a. a first suction plenum mounted to said machine and having an orifice extending in the side to side direction to capture waste and trash in a major exterior escape region of said machine;

b. a first waste concentrator means connected to said first suction plenum to receive a flow of air from said first suction plenum and separate the flow into a large volumetric flow of air cleared of entrained waste and trash and a small volumetric flow of air in which waste and trash is concentrated;

c. a first means attached to said machine to provide a flow of cleared air from said first waste concentrator means under positive pressure into the bottom region;

d. a pressure plenum mounted along a first side wall of the chassis, said pressure plenum connected in communication with said first means to receive the flow of air under pressure and having an emitting orifice extending from end wall to end wall to emit the pressurized air into the bottom region;

e. a second means attached to said machine to draw under a negative pressure a flow of air entraining waste and trash from the bottom region;

f. a second suction plenum connected to said second means, mounted along the opposite side wall of the chassis and having a receiving orifice formed spaced from and opposite the emitting orifice and extending from end wall to end wall through which is drawn a flow from the emitting orifice after the flow has crossed the floor and entrained waste and trash; and g. a second waste concentrator means connected to said second plenum to receive a flow from said second suction plenum and separate this flow between a large volumetric flow of air clear of entrained waste and trash and a small volumetric flow of air in which the waste and trash is concentrated.

11. The apparatus of claim 10 wherein said pressure plenum extends the length of the first side wall, is triangular in cross-section and includes a pair of triangular side plates of similar profile for use as right and left plenum sides, a vertical panel of planar rectangular configuration which is attached to the side plates, a horizontal panel of planar rectangular configuration which is attached to the bottom edges of the side plates and an inclined panel of planar rectangular configuration which is attached to the side plates to contact along one panel edge with the vertical panel and to define the emitting orifice between its opposite edge and the horizontal panel and wherein said second suction plenum extends the length of the opposite side wall is triangular in cross section and includes a pair of triangular side plates of similar profile for use as right and left plenum sides, a vertical panel of planar rectangular configuration which is attached to the side plates, a horizontal panel of planar rectangular configuration which is attached to the bottom edges of the side plates and an inclined panel of planar rectangular configuration which is attached to the side plates to contact along one panel edge with the vertical panel and to define the receiving orifice between its opposite panel edge and the horizontal panel.

* * * * *